US008096214B2

(12) United States Patent
Gao

(10) Patent No.: US 8,096,214 B2
(45) Date of Patent: Jan. 17, 2012

(54) RATCHETING HEAD WITH INTERNAL SELF-LOCKING ADAPTER RELATED APPLICATIONS

(75) Inventor: Hua Gao, Fox Point, WI (US)

(73) Assignee: Bradshaw Medical, Inc., Kenosha, WI (US)

( * ) Notice: Subject to any disclaimer, the term of this patent is extended or adjusted under 35 U.S.C. 154(b) by 0 days.

(21) Appl. No.: 12/378,871

(22) Filed: Feb. 20, 2009

(65) Prior Publication Data

US 2009/0205467 A1 Aug. 20, 2009

Related U.S. Application Data

(63) Continuation-in-part of application No. 11/725,841, filed on Mar. 20, 2007, now Pat. No. 7,992,472, which is a continuation-in-part of application No. 11/545,916, filed on Oct. 11, 2006, now Pat. No. 7,334,509, and a continuation-in-part of application No. 29/258,441, filed on Apr. 21, 2006, now Pat. No. Des. 562,665.

(51) Int. Cl.
*B25B 23/157* (2006.01)

(52) U.S. Cl. ..... 81/475; 81/58.3; 81/62; 81/63; 81/63.1

(58) Field of Classification Search ..... 81/58.3, 81/62, 63, 63.1, 475
See application file for complete search history.

(56) References Cited

U.S. PATENT DOCUMENTS

| | | | | |
|---|---|---|---|---|
| 6,568,693 | B2 * | 5/2003 | Glass | 279/80 |
| 7,213,491 | B1 * | 5/2007 | Thompson et al. | 81/58.3 |
| 2003/0213343 | A1 * | 11/2003 | Schuster | 81/73 |

* cited by examiner

*Primary Examiner* — Lee D Wilson
*Assistant Examiner* — Shantese McDonald
(74) *Attorney, Agent, or Firm* — Ryan Kromholz & Manion, S.C.

(57) ABSTRACT

A ratcheting assembly for a tool comprising a housing, a gear supported by a hollow shaft located in the housing and a pawl to engage the gear. A ring in contact with the housing allows adjustment of the ratcheting assembly. The assembly can the releasably lock the tool within the ratcheting assembly by way of a locking mechanism located within the shaft. The assembly further has a compressible collar that will be used to release the tool from the ratcheting assembly.

18 Claims, 4 Drawing Sheets

RATCHETING HEAD WITH INTERNAL SELF-LOCKING ADAPTER RELATED APPLICATIONS

RELATED APPLICATIONS

The present application is a continuation-in-part of U.S. patent application Ser. No. 11/725,841, filed Mar. 20, 2007, now U.S. Pat. No. 7,992,472, which is also a continuation-in-part of U.S. patent application Ser. No. 11/545,916, filed 11 Oct. 2006, now U.S. Pat. No. 7,334,509 and also a continuation-in-part of U.S. patent application Ser. No. 29/258,441, filed 21 Apr. 2006, now U.S. Pat. Des. No. D562,665.

BACKGROUND OF THE INVENTION

The present invention relates to ratcheting tools and adapters and, more specifically, to ratcheting tools that have ratcheting mechanisms along with adapters having self-locking capabilities.

Screwdrivers, socket-drivers and other hand-held tools are often utilized to insert, remove and/or adjust fasteners by rotating the fastener for proper positioning of the fastener with respect to the items. In order to ease rotation of the fasteners, the tools often include ratcheting mechanisms which enable the tool to apply a force to the fastener when the tool is rotated in one direction, and to allow the tool to rotate freely without applying a force to the fastener in the opposite direction.

Often when using such ratcheting mechanisms, the mechanisms are designed so that the specific tool is locked within the ratcheting mechanism. During various operations, the locking and unlocking (i.e. securing and removing) of the tool within the ratcheting mechanism must be done quickly and easily and, must sufficiently hold the tool or work piece in the ratchet during operation. For example, during surgical procedures, the operator of the device may be working in confined areas, where it is also important that the tool or work piece is securely held within the ratcheting mechanism.

SUMMARY OF THE INVENTION

The present invention provides a ratcheting mechanism that has an internal self-locking mechanism for locking a tool shaft within the ratcheting mechanism. The ratcheting mechanism generally is located within a housing and comprises a gear that will interact with a pair of pawls. The housing is connected to an adjustment ring, which allows the direction of the ratcheting mechanism to be changed. The ratcheting mechanism is connected to a connecting section that will allow the ratcheting mechanism to be connected to a driver or handle.

The ratcheting. mechanism further interacts with a compressible collar. The compressible collar allows movement of an internal locking device, such as a ball bearing that will interact with an internally orientated tool shaft, centrally located of the gear, to lock and secure the internal shaft to the ratcheting mechanism. The compressible collar is also located internally of the ratcheting mechanism. The tool shaft is that of a typically designed tool or tool bit, such as a socket wrench, screwdriver bit, allen wrench bit, or other similar work piece.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
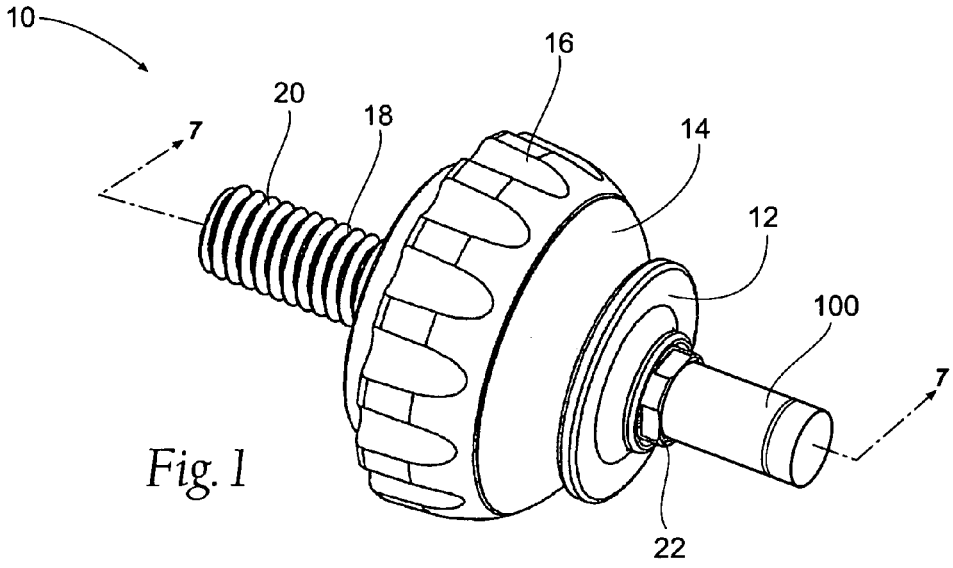
FIG. 1 is a perspective view of a ratcheting assembly for a tool according to the present invention.

FIG. 1 is a perspective view of a ratcheting assembly 10 according to the present invention. The assembly generally comprises a compressible collar 12, a housing 14, an adjustment ring 16, and a connection section 18. The connection section 18 preferably comprises a standard threaded portion 20 for connecting the assembly to a further driver handle or device (not shown). It is also understood that the connector section 18 could be considered or designed as a handle or driver and the present invention would encompass such arrangements and designs. The assembly 10 further has an adapter section 22 that allows the assembly 10 to be attached to a tool or workpiece that has a tool body 100. The compressible collar 12 preferably circumscribes the adapter section 22, but other arrangements are possible, as well.

Figure 2:
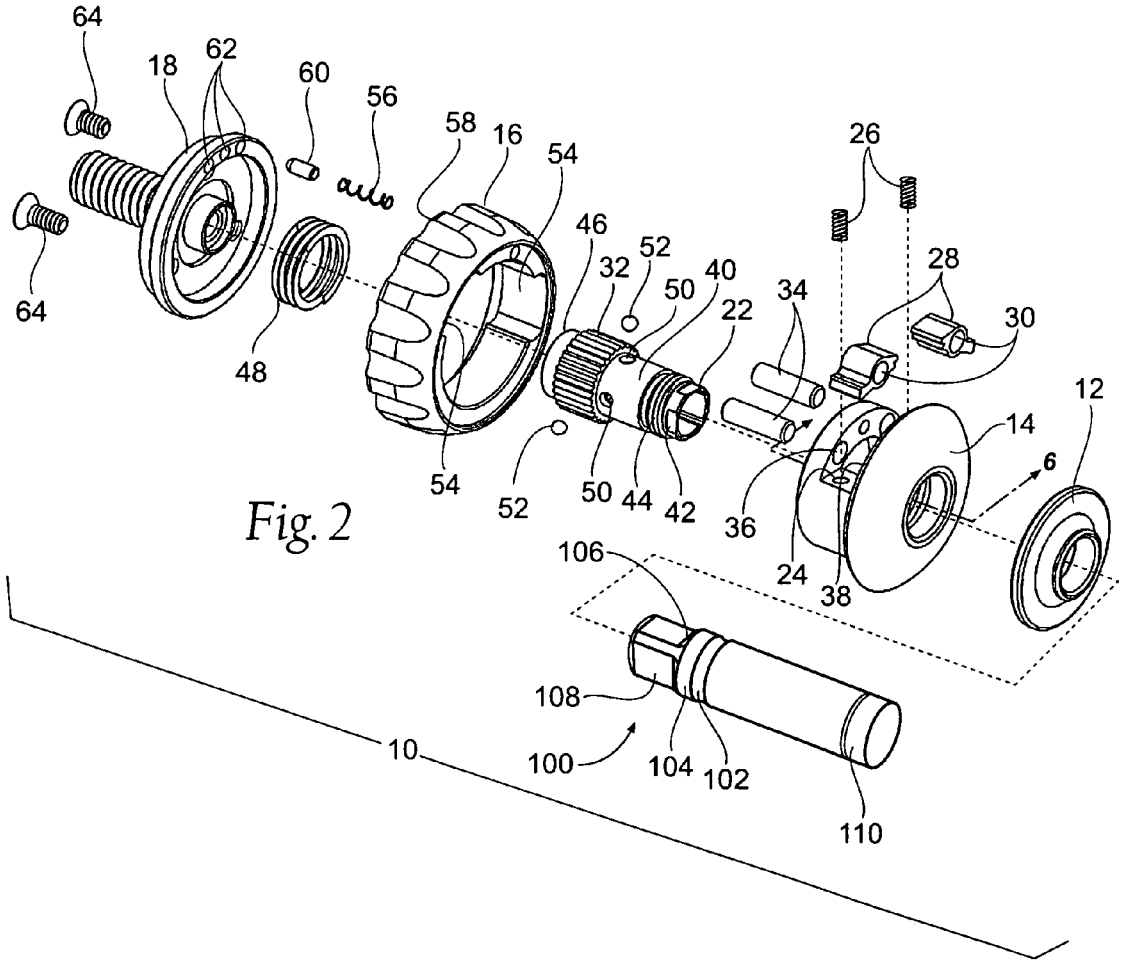
FIG. 2 is an exploded view of the ratcheting assembly shown in FIG. 1.

FIG. 2 provides an exploded perspective view of the assembly 10. The housing 14 has a pair of holes 24 that each hold in place a spring 26. The springs 26 provide biasing means for a pair of pawls 28 located within in the housing 14. The pawls 28 generally comprise triangular, wedge-shape structures, but any shape that will function properly for ratcheting purposes can be used in the present invention. Each of the pawls 28 has a throughbore 30. The pawls 28 provide the necessary engagement with a gear 32 so that the assembly 10 acts as a ratcheting assembly. Further within the housing are a pair of respective pins 34 that each are inserted into a first respective pin hole 36, a respective throughbore 30, and a second respective pin hole 38.

Still referring to FIG. 2, the gear 32 is situated on a shaft 40 that provides the necessary support for gear 32. The gear 32 and the shaft 40 may be designed or machined as separate pieces, or as a single piece. The shaft 40 has a first end 42 which forms the adapter section 22 shown in FIG. 1. The hollow interior of the adapter section 22 allows for the insertion of the tool body 100 into the shaft 40. The tool body 100 has a polygonal shape, such as a square or hexagonal shape, with the adapter section/shaft having a respective mating shape. The shaft 40 also comprises a threaded section 44, which allows the shaft 40 to be mated with the compressible collar 12. The shaft 40 also has a second end 46, preferably designed to support a spring 48, that allows the shaft 40 to be biased against the assembly 10. The shaft 40 also comprises a pair of openings 50, with a respective ball bearing 52 situated within each opening 50, that assists in the internal locking arrangement for the assembly 10. The bearings 52 are partially located within the shaft 40, so that they are capable of engaging both the housing 14 externally of the shaft 40 and the tool body 100 internally of the shaft to secure the shaft 100 in place, as is demonstrated in FIGS. 8-10. It should be understood that other objects could be used instead of ball bearings and would fall within the scope of the present invention. For example, other bearings or rolling members, such as cylinders or conical shaped devices, depressible pins, or buttons, could be used as bearings within the present invention.

Referring further to FIG. 2, the adjusting ring 16 comprises oppositely disposed cutouts 54, which receive and hold a respective pawl 28 within the housing 14. A helical spring 56 is nested within a cavity 58 located within the adjusting ring 16 and is used as further biasing means against a plunger 60, which will be selectively inserted into one of a plurality of detents 62, depending on the desired directional movement of the ratcheting assembly 10. The detents 62 are located on the connection section 18, which is secured to the housing 16 by way of a plurality of fasteners, such as screws 64.

Figure 3:
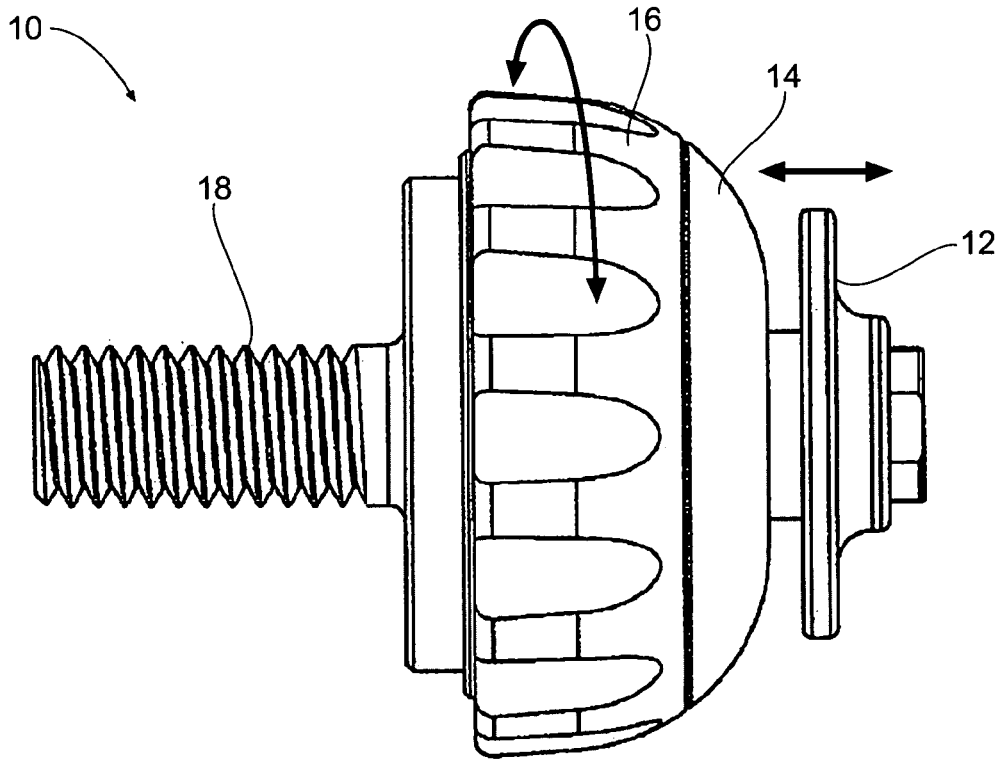
FIG. 3 is a side elevation view of the ratcheting assembly shown in FIG. 1.

FIG. 3 shows a side elevation view of the assembly 10. As previously discussed, the assembly 10 comprises the compressible collar 12, which can be moved inwardly and outwardly with respect to the housing 14 and the adjustment ring 16. This allows the tool shaft 100 to be locked in position with respect to the ratcheting mechanism 10, which will be discussed in further detail with respect to FIGS. 7-10. The adjusting ring 16 allows the ratcheting assembly 10 to be moved between a forward and reverse ratcheting direction.

Figure 4:
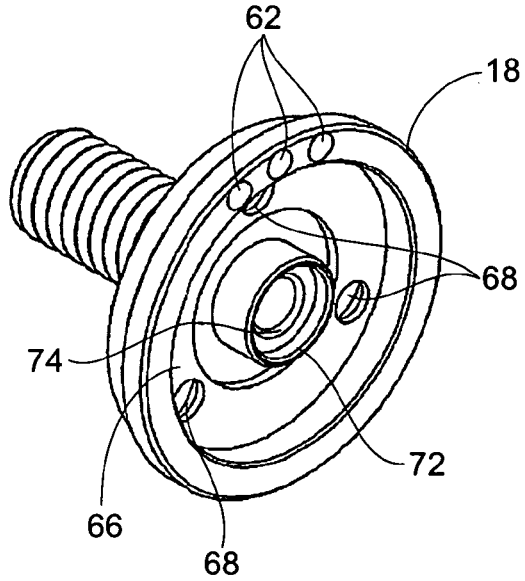
FIG. 4 is a perspective view of a tool adapter used in the ratcheting assembly of the present invention.

FIG. 4 shows a perspective view of the connector section 18, which allows the assembly 10 to be attached to a handle or a driver. The connector section 18 provides an interior surface 66, which provides the necessary surface to bias the shaft 40 and the spring 48 (see FIG. 2) for operation of the assembly 10. The surface 66 can be considered a surface of the housing 14 and/or of the assembly 10, in general. The connector section 18 has a plurality of throughways 68 that allow the screws 64 (FIG. 2) to pass through the connector section 18 and into bores 70 (FIG. 5) to secure the connector section 18 to the housing 14. The connector section 18 also has a central section 72 having an outer diameter shaped to receive the shaft 40, and, also, a recessed area 74 arranged to fittingly receive the spring 48.

Figure 5:
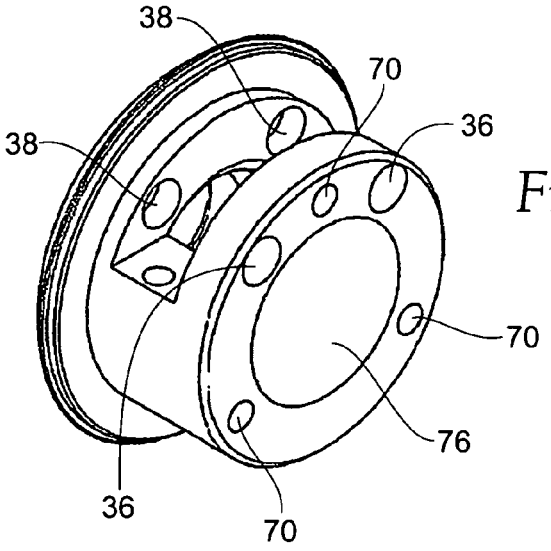
FIG. 5 is a perspective view of a housing used in the ratcheting assembly of the present invention.
Figure 6:
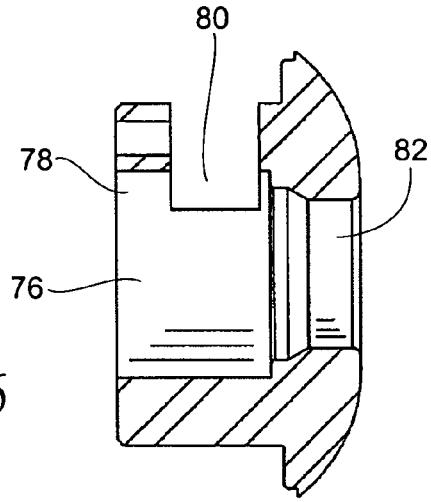
FIG. 6 is a cross-sectional view of the housing shown in FIG. 5 taken along line 6-6 of FIG. 2.
Figure 7:
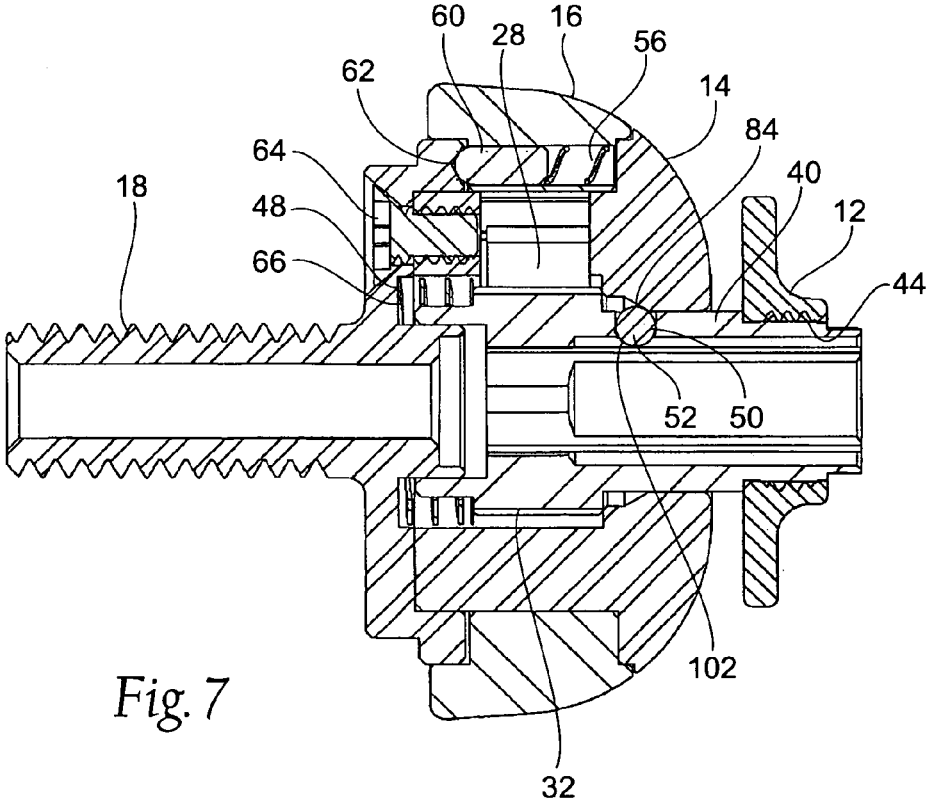
FIG. 7 is a cross-sectional view of the ratcheting assembly of the present invention shown in a first arrangement, taken along line 7-7 of FIG. 1.

FIG. 5 shows a perspective view of the housing 14. The design of the housing 14 allows the shaft 40 to be inserted into an interior 76 of the housing 14. As shown in FIG. 6, the interior 76 has a first section 78 that has a cutaway section 80 for the pawls 28 to interact with the gear 32. The interior 76 also has a second section 82 that has a tapered surface 84, which will assist in locking the ratcheting assembly 10 in position by providing an abutment for the ball bearings 50 to rest against. As will be demonstrated with respect to FIGS. 7-10, the locking bearings 52 are located between the tapered surface 84 and the openings 50, to provide the necessary interaction and positioning of the locking bearings 52 with respect to the shaft 100 to secure the assembly 10 in a specific position. The tapered surface 84 allows the bearing 52 to slide or rotate along the surface, but the surface 84 could take other shapes and forms that would hold the bearing 52 in the necessary arrangement.

FIGS. 7-10 provide cross-sectional views of the assembly 10 demonstrating various stages of the locking balls 50 interacting with the shaft 40 and the tool shaft 100. As previously described, the connection section 18 is secured to the housing 14 by way of the screws 64. The adjustment ring 16 is situated around the housing 14, with the pawls 28 interacting with the gear 32 within the housing 14. The plunger 60 is biased within a detent 62 by the use of the spring 56, which locks the assembly 10 in a respective operating direction. The gear 32 and the shaft 40 are biased against the interior surface 66 of the connection section 18. The bearing 52 abuts the tapered surface 84 and is situated within the opening 50 located in the shaft 40. The compressible collar 12 is threaded onto threaded section 44, which allows the collar 12 to be operated to move the shaft 40 inwardly, with the shaft 40 returning to where the bearing 52 abuts the tapered surface 84 once external pressure is removed from the collar 12.

Figure 8:
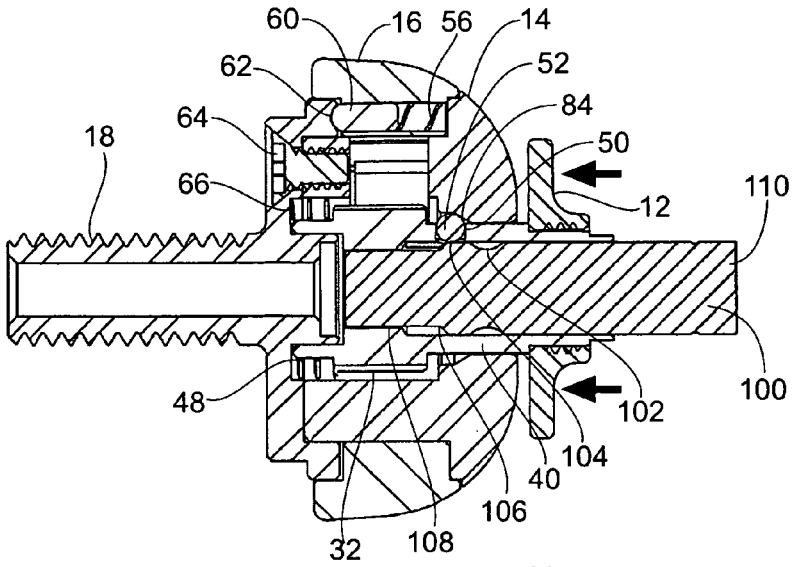
FIG. 8 is a cross-sectional view of the ratcheting assembly of the present invention shown in a second arrangement, taken along line 7-7 of FIG. 1.
Figure 9:
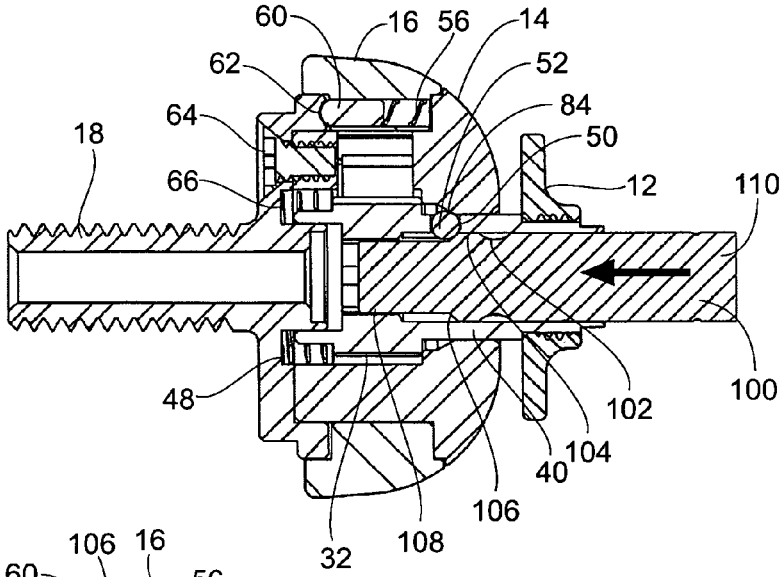
FIG. 9 is a cross-sectional view of the ratcheting assembly of the present invention shown in a third arrangement, taken along line 7-7 of FIG. 1.
Figure 10:
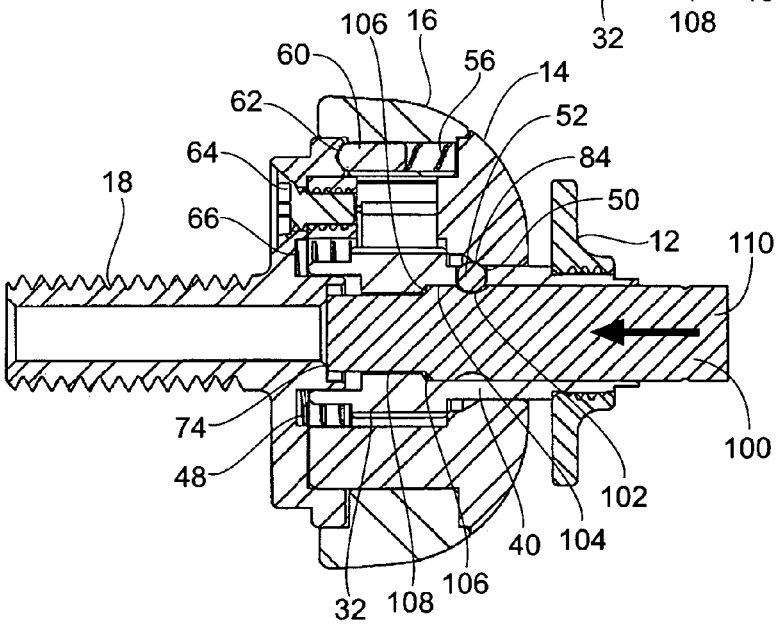
FIG. 10 is a cross-sectional view of the ratcheting assembly of the present invention shown in a fourth arrangement, taken along line 7-7 of FIG. 1.

Still referring to FIGS. 7-10, FIG. 7 shows the assembly 10 without the tool body 100 inserted within the shaft 40, while FIGS. 8-10 show the locking shaft 100 inserted within the shaft 40. As noted above in FIG. 7, the collar 12 can be used to move the shaft 40 inwardly, and the shaft 40 will return to the position shown in FIG. 7 when pressure is removed from the collar 12. However in FIGS. 8-10, the insertion of the tool body 100 will contribute to the locking mechanism for the assembly 10.

FIG. 8 shows the tool body 100 inserted within the shaft 40. The tool body 100 has an indent 102 located between a first end 108 that is inserted into the shaft 40 and a second end 110 that will form a typical tool bit or adapter, such as a socket wrench adapter. The first end 108 has a first dimension that allows the shaft 100 to be fittingly placed within the adaptor section and the shaft 40. Preferably, the first end has a square shape or hexagonal shape of a standard bit or adaptor, such as a drill bit, screwdriver bit, or allen wrench bit. An outwardly tapered area 106 leads to a level area 104, which is located between the tapered area 106 and the indent 102.

Still referring to FIG. 8, the collar 12 is shown being pushed inwardly, which allows insertion of the tool shaft 100 into the shaft 40. The ball bearing 52 is now positioned between the tapered section 84 of the housing 14 and the level area 104. The shaft 40 and the gear 32 are moved inwardly, as well, as they are connected to the collar 12.

Referring to FIG. 9, the ball bearing 52 is shown situated between the tapered surface 84 of the housing 14 and the tapered area 106 of the shaft 100. In this arrangement, the tool shaft 100 is not locked to the assembly 10, and the user is able to push the tool shaft 100 entirely within the shaft 40 to engage the end surface 74. The ball bearings 52 and the shaft 40 will be pushed inward and allow the shaft 100 to pass by the bearings 52. The spring 48 will then be able to push the shaft 40 back to the locking position or operating position. The gear 32 and the pawls 28 will be aligned with another when in the operating position.

FIG. 10 shows the shaft 100 being pushed further inwardly, with the first end 108 of the shaft 100 abutting the recessed area 74 of the interior surface 66 of the connector section 18. The ball bearing 52 is now located between the indent 102 and the tapered section 84 of the housing 14. Thus, the tool shaft 100 is locked in place by pushing the tool shaft 100 inwardly, without any extra action or movement of the assembly 10 or of the locking mechanism (i.e. the shaft 40, collar 12, or bearing 52). Once the ball bearing 52 is located within the indent 102 and pressure is removed from the collar 12, the shaft 40 and the gear 32 will move outwardly, so that the gear 32 is aligned with the pawls 28 (compare the position of the gear 32 in FIG. 9 and FIG. 10). The resultant arrangement locks the assembly 10 in place with respect to the shaft 100, allowing proper torque to be delivered by the assembly 10 to a tool (not shown). If inward external pressure is delivered to the collar 12 (shown as arrows in FIG. 8), the shaft 100 will be moved outwardly, releasing the ball bearing 52 from the indent 102, and returning the assembly 10 to the arrangement shown in FIG. 9. That is, pulling upwardly on the collar 12 with respect to the assembly 10 will release the tool body 100 from the assembly 10.

The arrangement of the present invention provides a ratcheting assembly 10 that has an easy to use and efficient locking function for the assembly 10. The internal locking arrangement for the shaft 40, with the ball bearings 52 being used to interact internally of the shaft 40 to lock the assembly 10 in an operating position with respect to the tool body 100, allows for the locking arrangement to take place without interfering with the ratcheting mechanism of the assembly 10. The internal arrangement, including the collar 12 being located internally of the ratcheting mechanism, also provides a locking mechanism that is independent of where the assembly 10 is gripped by a user, i.e. either the ratcheting assembly or an attached handle. This minimizes the chance that the user will inadvertently disengage the tool body 100 from the assembly 10 when in use.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A ratcheting assembly for a tool comprising:
a housing;
a gear located in said housing;
at least one pawl, said pawl being in releasable engageable contact with said gear to provide ratcheting action for said ratcheting assembly;
means for adjusting the ratcheting action of said pawl;
a hollow adapter for receiving said tool; and
means for securing said tool to said ratcheting assembly, said securing means located internally of said adapter, wherein said securing means simultaneously engages said tool and said housing, said securing means being independent of said adapter.

2. The ratcheting assembly according to claim 1 further comprising means for releasing said tool from ratcheting assembly.

3. The ratcheting assembly according to claim 2 wherein said releasing means further comprises a collar connected to said adapter.

4. The ratcheting assembly according to claim 3 wherein said adapter is biased against said ratcheting assembly.

5. The ratcheting assembly according to claim 1, wherein said adapter comprises a shaft, said shaft supporting said gear.

6. The ratcheting assembly according to claim 5, wherein said shaft further comprises at least one opening located on said shaft,
wherein said securing means further comprises a bearing positioned in said opening, said bearing engaging said tool to secure said tool in said ratcheting assembly.

7. A ratcheting assembly for a tool comprising:
a housing;
a gear located in said housing;
a movable hollow shaft located in said housing and biased against said housing, said shaft supporting said gear, said shaft being capable of receiving said tool;
at least one pawl, said pawl being in releasable engageable contact with said gear to provide ratcheting action for said ratcheting assembly, said pawl being aligned with said gear when said ratcheting assembly in an operating position;
means for adjusting the ratcheting action of said pawl; and
means for securing said tool to said ratcheting assembly, said securing means located internally of said shaft, wherein said securing means simultaneously engages said tool and said housing said securing means being independent of said hollow shaft.

8. The device according to claim 7 further comprising means for releasing said tool from said ratcheting assembly.

9. The device according to claim 8 wherein said releasing means comprises a collar connected to said adapter.

10. The ratcheting assembly according to claim 9 wherein said adapter is biased against said ratcheting assembly.

11. The ratcheting assembly according to claim 7 wherein said shaft further comprises an opening,
wherein said securing means further comprises a bearing located within said opening, said bearing engaging said tool to secure said tool in said ratcheting assembly.

12. The ratcheting assembly according to claim 11 wherein the bearing comprises a ball bearing.

13. The ratcheting assembly according to claim 7, wherein said adjusting means further comprises a ring situated around said housing and arranged to interact with said pawl.

14. A ratcheting assembly for a tool comprising:
a housing;
a gear located in said housing;
at least one pawl, said pawl being in releasable engageable contact with said gear to provide ratcheting action for said ratcheting assembly;
means for adjusting the ratcheting action of said pawl;
an internally located, releasable locking mechanism for the ratcheting assembly comprising:
a hollow shaft located in said housing and biased against said ratcheting assembly, said shaft supporting said gear, said shaft being capable of receiving said tool;
means for releasably securing said tool to said ratcheting assembly, said securing means located internally of said shaft, wherein said securing means simultaneously engages said tool and said housing, said securing means being independent of said hollow shaft; and
a compressible collar connected to said shaft, wherein an outward movement of said compressible collar releases said tool from said ratcheting assembly.

15. The ratcheting assembly according to claim 14, wherein securing means comprises a bearing.

16. The ratcheting assembly according to claim 15, wherein said shaft further comprises an opening, said opening supporting said bearings.

17. The ratcheting assembly according to claim 14 wherein the adjusting means further comprises a ring surrounding said housing and arranged to interact with said pawl.

18. The ratcheting assembly according to claim 14 further comprising a pair of pawls.

* * * * *